United States Patent [19]

Zannoni

[11] Patent Number: 4,492,043

[45] Date of Patent: Jan. 8, 1985

[54] APPARATUS AND METHOD FOR DRYING PARTICULATE MATERIAL

[75] Inventor: Cristiano Zannoni, Ravenna, Italy

[73] Assignee: Phillips Petroleum Company, Bartlesville, Okla.

[21] Appl. No.: 394,213

[22] Filed: Jul. 1, 1982

[30] Foreign Application Priority Data

Mar. 26, 1982 [IT] Italy ..... 20405 A/82

[51] Int. Cl.[3] ..... F26B 3/28

[52] U.S. Cl. ..... 34/39; 34/134; 34/138; 165/89; 432/114; 432/148

[58] Field of Search ..... 34/134, 138, 39; 165/89; 432/31, 112, 114, 148

[56] References Cited

U.S. PATENT DOCUMENTS 727,513 5/1903 Waterhouse ..... 34/138
4,205,458 6/1980 Austin ..... 34/134

FOREIGN PATENT DOCUMENTS 61285 1/1948 Netherlands ..... 34/138

*Primary Examiner*—Larry I. Schwartz

[57] ABSTRACT

Improved method for internal heating of rotary driers consisting in the use of an unique snorkel (placed inside the rotary drum) made by two opposite snorkels connected by any type of joint. This unique snorkel extends from feed end to discharge end of the rotary drum along its axial line. Part of the heating gases of the fire box flow (equicurrent or countercurrent to the flow of the material being dried) inside the snorkel-controsnorkel system.

10 Claims, 7 Drawing Figures

APPARATUS AND METHOD FOR DRYING PARTICULATE MATERIAL

The subject of the present invention is an improved system for internal heating of rotary driers, consisting in a snorkel joined to a contro-snorkel by any type of joint.

The snorkel plus controsnorkel go along the drier from feed end to discharge end, while part of the heating gases of the fire box flow (equicurrent or countercurrent to the flow of the material being dried) inside the snorkel plus controsnorkel system.

The present invention can be used for drying any material but it is herein specifically referred to carbon black which is presently of interest for the applicant.

Carbon black is produced by incomplete combustion of hydrocarbons under controlled conditions, and is mostly used as rubber and plastics reinforcing agent. Carbon black is generally pelletized with addition of water which has to be removed prior to storing and shipping. Drying has to be accomplished under controlled conditions not to affect the surface chemistry and properties of the carbon black.

FIG. 1 schematically illustrates one type of rotary drum dryer according to the prior art.

FIG. 2 schematically illustrates another type of rotary drum dryer according to the prior art.

Figure 1:
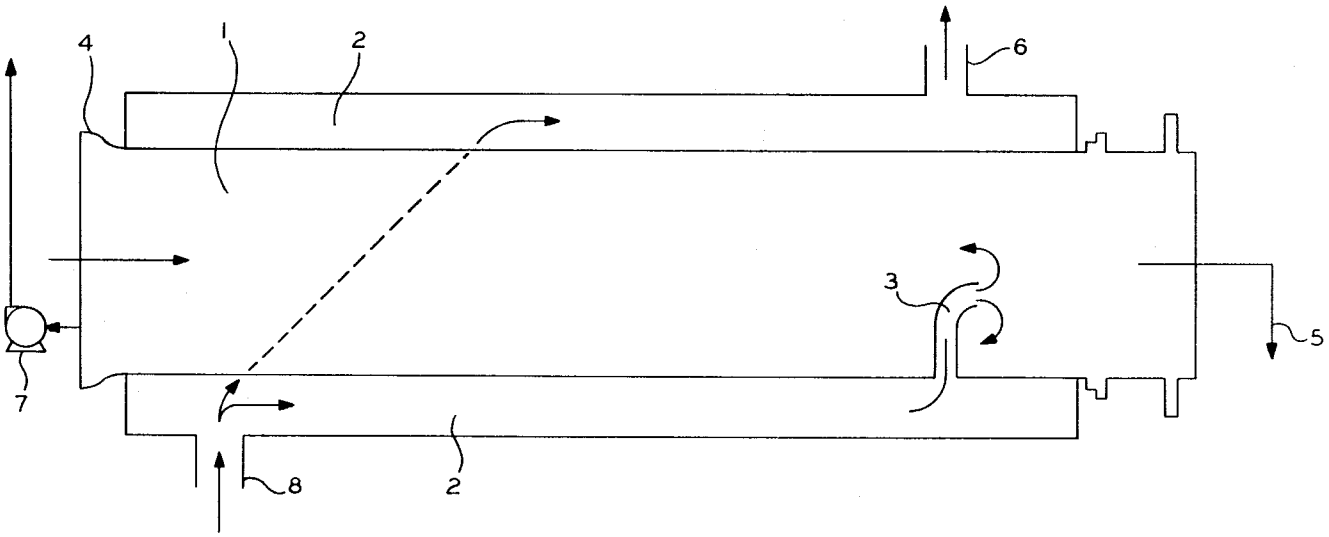
FIG. 1 (PRIOR ART)
FIGS. 1 and 2 show two well known types of carbon black rotary drum driers.

(1) is the rotary drum;
(2) is the hot gas annulus where the heating gases do flow cocurrent to the flow of the carbon black being dried;
(3) is the snorkel (two different types);
(4) is the feed end of the rotary drum;
(5) is discharge end of the rotary drum;
(6) is the stack;
(7) is the purge fan;
(8) is the heating gas inlet.

The heating gases flow in the fire box 2 escaping exhausted through the stack 6 (indirect heating). Part of the heating gases enters the rotary drum 1 through the snorkel 3, flows countercurrently to the carbon black toward the feed end 4 (direct heating) being drafted by the purge fan 7 which pulls out the water vapor as well.

The heating gases flow cocurrently with the carbon black (even if the drying efficiency is slightly lowered) so as to not affect to product quality and to prevent:

(1) heat stress of the rotary drum;
(2) corrosion of the flights (not illustrated) of the rotary drum, corrosion of the snorkel supports, corrosion of the inside rotary drum shell.

The hottest heating gases contact the cold feed end of the rotary drum whereas the coldest heating gases (already exhausted) contact the warm discharge end of the rotary drum.

The skin temperature of the rotary drum is therefore kept below the dangerous levels at which the mechanical properties of the rotary drum would be decreased.

Figure 2:
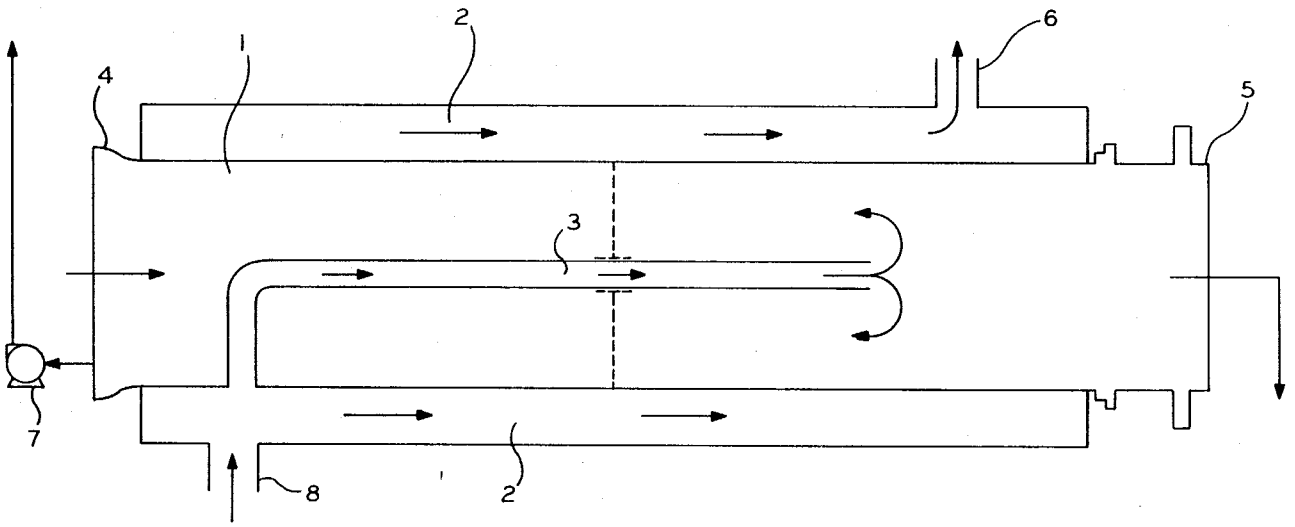
FIG. 2 (PRIOR ART)

The flights of the rotary drum (not shown) and the supports (dashed lines in FIG. 2) of the snorkel, and of the feed end where the cold wet pellets enter the rotary drum are heated by the hottest heating gases. The temperature of the feed inlet end does not fall below the dew point and there is no corrosion.

Figure 3:
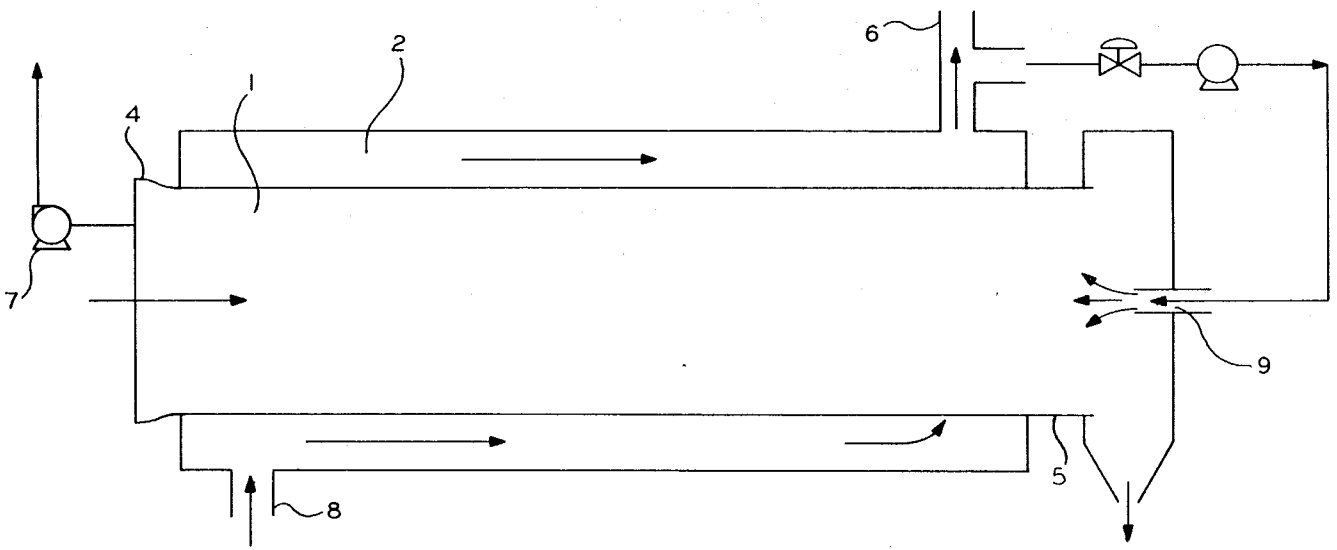
FIG. 3 (PRIOR ART)
FIG. 3 illustrates yet another type of rotary drum dryer according to the prior art.

Another type of indirect and direct heating is shown in FIG. 3. The heating gases already exhausted are drafted by a fan from the stack 6 and sent as purge gas into the rotary drum 1 through the pipe 9 countercurrent to the carbon black being dried.

The introduction of heating gases into rotary drum (regardless the way this direct heating is accomplished) causes the following problems:

(1) May aftertreat the material being dried and alter its properties;
(2) Increases the volume of gases to be removed from the rotary drum. The purge fan 7 has to pull out not only the water vapor released from the material being dried but also the heating gases coming through pipe 9;
(3) Some heating gases entering the rotary drum through the pipe 9 can escape together with the dried material if the purge fan cannot cope with the flowrate of the heating gases entering the rotary drum through the pipe 9;
(4) The presence of $SO_2$ in the heating gases can corrode the filter which recovers the fines of the material carried over by the water vapor and purge gas (which are both pulled out by the purge fan 7).

Figure 4:
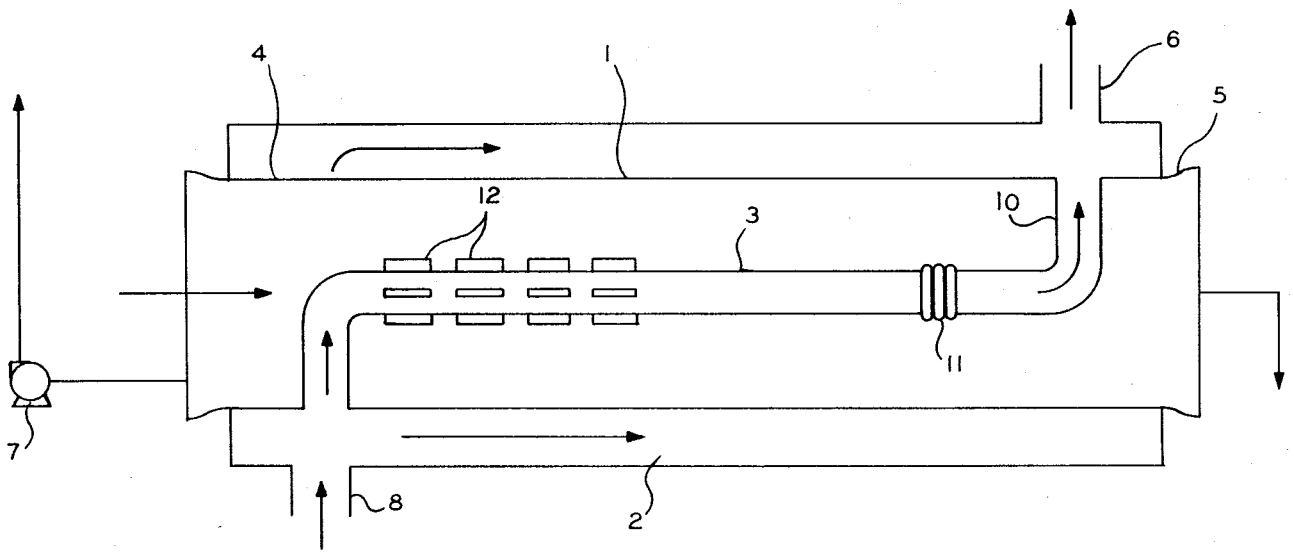
FIG. 4 illustrates schematically certain aspects of one embodiment of the present invention.

The present invention helps to solve these problems. This invention is schematically shown in FIG. 4 where:

(3) is the snorkel;
(10) is the contrasnorkel;
(11) is the snorkel plus contrasnorkel joint; and
(12) are flights welded onto to the snorkel preferably throughout its whole length to increase the heat transfer from metal to any material being dried.

The junction between the snorkel with the contrasnorkel can be made by any type of expansion joint to compensate for different thermal expansions between rotary drum and the snorkel plus contrasnorkel system and to prevent (if ever needed) leakages of heating gases into the rotary drum in order not to effect the properties of the material being dried.

DETAILED DESCRIPTION

Figure 5:
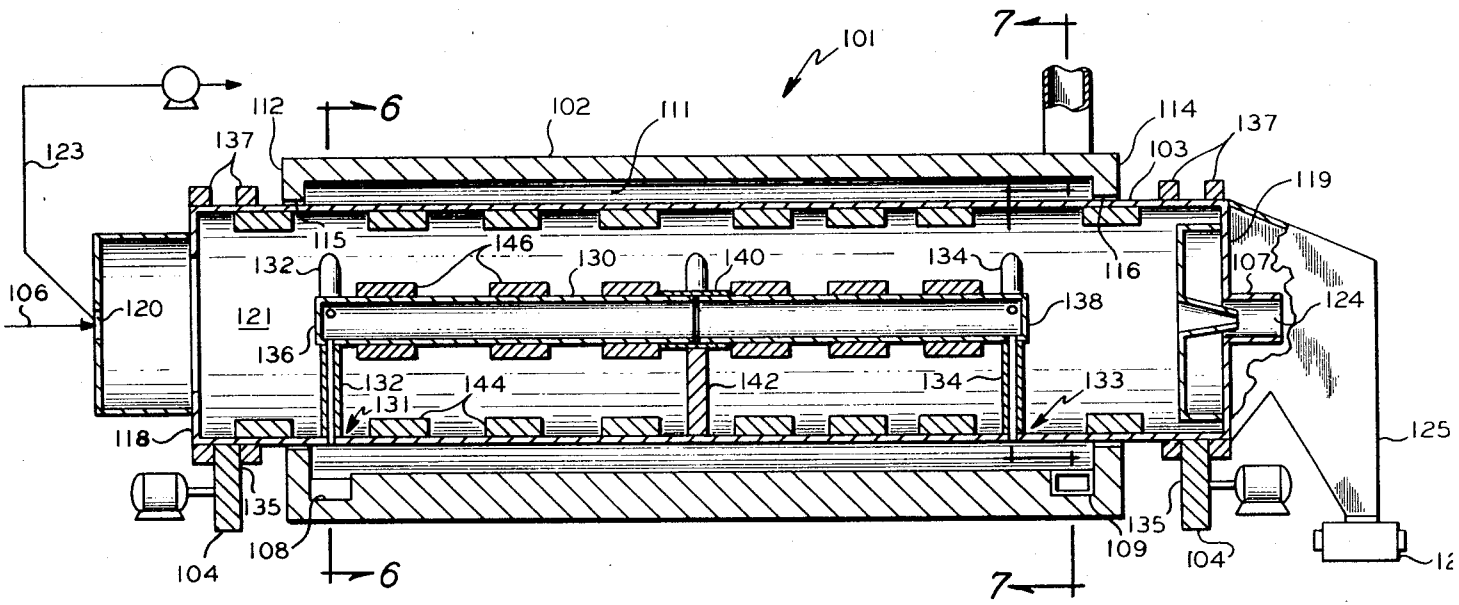
FIG. 5 is a cross-sectional view of an apparatus embodying certain features of the present invention.
Figure 7:
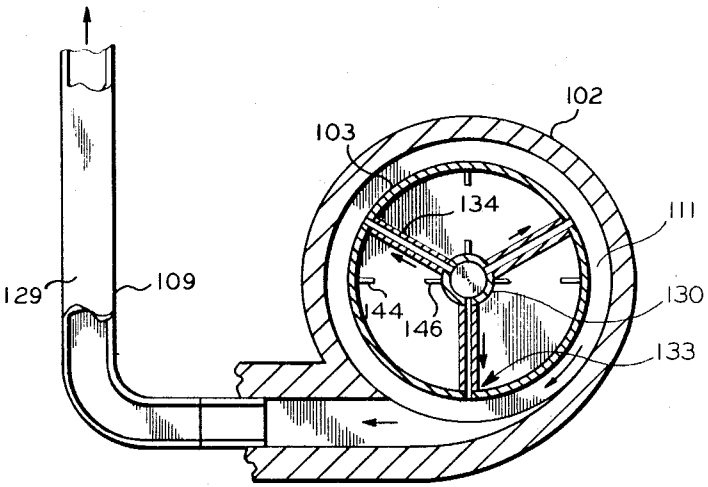
FIG. 7 is a sectional view of the apparatus shown by FIG. 5, taken along the indicated lines.
Figure 6:
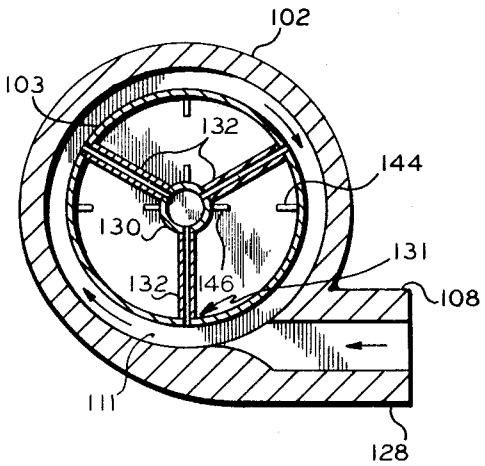
FIG. 6 is a sectional view of the apparatus shown by FIG. 5, taken along lines 6—6.

Referring to FIGS. 5-7, the reference numeral 101 designates generally an apparatus for drying particulate material. The apparatus 101 includes an elongate housing 102 which defines an interior chamber 111 and which has mounted therein a drum 103. Preferably the drum 103 is mounted for rotation about its longitudinal axis usually tilted from the horizontal and is driven for rotation by drive means 104. Particulate material inlet means 106 is at one end of the drum 103 while at the other end of the drum 103 there is provided outlet or discharge means 107. Heating medium is supplied to the housing 102 for heating particulate material contained within the drum 103. The heating medium is introduced into the housing 102 via inlet means 108. Preferably, the means 108 is positioned and directed to inject the heating medium in a generally tangential direction relative to the chamber 111 to effect vortex flow of the heating medium along the length of the drum 103. The heating medium after flow along the exterior of the drum 103 is discharged via an outlet means 109, which also preferably empties into the chamber 111 in a generally tangential direction. Preferably, heating medium and particulate material flow cocurrently, to prevent possibly overheating the particulate material, although countercurrent flow can be used.

The housing 102 can have any desirable exterior shape and has an interior surface which preferably is generally cylindrical and defines the interior chamber or zone 111. The chamber 111 as defined between the interior of the housing and the exterior of the drum is preferably tubular, having a longitudinal axis and an annular cross section in a plane normal to the axis. At opposite ends 112 and 114 of the housing 102 there are provided openings 115 and 116, respectively, through which the drum 103 extends. The space between the surfaces defining the openings 115 and 116 and the exterior of the drum 103 is sealed or otherwise kept at a minimum to prevent the loss of heating medium or prevent the unintentional introduction of air into the chamber 111. The housing 102 can be of any suitable material such as a refractory or metal and preferably is insulated to reduce the exterior temperature thereof and reduce heat loss therefrom. Also, the refractory will become heated and provide radiant heat transfer to the drum 103 particularly in the proximity of the end 112. The drum 103 and related parts are preferably formed from stainless steel.

The drum 103 preferably is generally cylindrically shaped and is elongate, having opposite ends 118 and 119 extending through the openings 115 and 116, respectively. The exterior of the drum 103 is spaced from the interior surface of the housing 102 such that the chamber 111 is preferably an annular space which is generally cylindrical for flow of heating medium along a major portion of the length of the exterior of the drum 103. The annular spacing between drum 103 and housing 102 is usually about 6 to about 8 inches (15–20 cm). The end 118 is an inlet end while the end 119 is an outlet or discharge end for the particulate material. The inlet means 106 cooperates with the end 118 in a suitable manner such that during rotation of the drum 103 particulate material such as wet loose carbon black or wet pelleted carbon black is introduced through an opening 120 into a drying chamber or zone 121 of the drum 103. The end 119 has a discharge opening 124 through which at least substantially dried particulate material is discharged from the drying chamber 121. The discharge opening 124 preferably opens into a stationary hood 125, or the like and through a suitable valve means 126 such as a star valve which is effective for preventing the loss of gases through the opening 124 or the entry of air into the chamber 121.

The inlet means 108 includes a conduit means 128 (FIG. 6) which extends through the wall of the housing 102 and opens into the annular space 111 preferably immediately adjacent to or at the end 118. Preferably, the conduit means 128 is directed in a generally tangential direction, relative to the annular space 111, into the annular space 111 such that heating medium injected into the annular space via the conduit 128 will flow in a generally vortex manner in the annular space along the exposed length of the drum 103 in the chamber 111. Vortex flow of heating medium is preferred because it causes improved heat transfer into the particulate material. The annular space 111 functions as a heating chamber or zone for heating drum 103 so that the particulate material contained within the drum 103 is heated by indirect heat exchange with the heating medium. After the heating medium has flowed in annular space 111 along the length of the drum 103 within the housing 102, the heating medium is discharged via the oulet means 109 (FIG. 7). The outlet means 109 can assume any suitable shape or configuration and as shown the outlet means 109 includes a conduit means 129 which opens into the annular space 111 and is preferably generally tangentially directed relative to the annular space 111, preferably for corotational discharge of heating medium. Corotational discharge from the annular space 111 will result in the discharged heating medium being subjected to less pressure drop during discharge. The conduit means 129 preferably opens into the annular space 111 immediately adjacent to or at the end 119. The inlet conduit 128 can be decreased in cross-sectional area at the outlet end to increase the velocity of the heating medium in order to improve heat transfer. The conduit 129 can form a stack to create a draft which helps exhaust the heating medium.

To enhance the efficiency of the drying of the particulate material, an elongate tubular member 130 is mounted within the drying chamber 121 and is generally coaxial with the drum 103. The tubular member 130 preferably extends along a major portion of the length of the drying chamber 121, for example, between 60 and 90% or more of the length of the drum. Inlet means 131 connects in flow communication the annular space 111 and the tubular member 130. Outlet means 133 connects in flow communication the annular space 111 and the tubular member 130, preferably at the opposite end of the drying chamber 121. The inlet means 131 as shown includes at least one preferably generally radially extending, with respect to the tubular member 130, conduit 132. Each conduit 132 has one end opening into the annular space 111 and the other end opening into the tubular member 130 preferably immediately adjacent the end of the tubular member 130 most adjacent the inlet end 118. Similarly, the outlet means 133 as shown includes at least one preferably generally radially extending conduit 134 connecting the tubular member 130 with the annular space 111. Each conduit 134 is preferably positioned immediately adjacent the end of the tubular member 130 most adjacent the outlet end 119. It is important that the interior of the tubular member 130 be at least substantially isolated from the drying chamber 121. In the illustrated embodiment, the tubular member 130 is fitted with a closure 136 at its upstream end and a closure 138 at its downstream end. The process improvement brought about by these features is that the hot gases which are introduced into the tubular member 130 from the annular zone 111 are reintroduced further downstream back into the annular zone, and preferably are not exhausted into the drum. A first portion of the heating medium passes through the tubular chamber 111 from inlet means 108 to outlet means 109. A second portion of the heating medium flows from the tubular chamber or annular zone 111 through the conduits 132 and then along the length of the tubular member 130 in a direction generally cocurrent with the direction of movement of particulate material from the end 118 to end 119 along the drying chamber 121. The second portion of the heating medium is discharged from the tubular member 130 via the at least one conduit 134 and back into the tubular chamber or annular zone 111. Preferably, the conduit 134 is at or immediately adjacent the end of the tubular member opposite the end into which the conduits 132 open. The combined first and second portions of the heating medium flow out the outlet means 109 which preferably is positioned immediately adjacent or at the discharge end 119 of the drum 103.

To compensate for thermal expansion and contraction when in use, the tubular member 130 is preferably provided with an expansion joint (as 11 in FIG. 4), which preferably connects a first portion of the tubular member with a second portion of the tubular member. An expansion bellows is the perferred joint, because it most reliably seals the interior of the tubular member from the exterior. Where the tubular member 130 is of considerable length, such as in excess of about 10 feet (3 meters), it is desirably supported between its ends by a bracket 142. Preferably, the bracket 142 is fixedly mounted to the interior of the drum 103, but adapted for slidably mounting at 140 the tubular member 130, to allow for thermal expansions and contractions.

The particulate material during drying is preferably agitated, which is advantageously accomplished by rotating the drum 103 about its longitudinal axis via the drive means 104. To increase agitation and heat transfer, the interior of the drum 103 is preferably provided with lifting flights or radial fins 144. Fins 144 extend in a longitudinal direction along the interior of the drum 103. To further increase heat transfer, fins 146 extend radially outwardly from and longitudinally along the tubular member 130. Preferably substantially the entire length, such as 80–100% of the tubular member is provided with fins. The fins 146 are preferably formed from a heat transmissive material, and indirect heat exchange is effected between the heating medium passing through the tubular member and the carbon black pellets in the drum via the fins. Water vapor removed from the carbon black pellets, as an example of the material being dried, is removed via conduit 123, for example, to a filter. The drive means 104 can be of any suitable type such as power driven wheels 135 which preferably drive the drum via frictional contact between the drum and the wheels 135. As is known in the art, a track 137 can be provided on the exterior of the drum 103 to maintain the drum 103 in proper alignment during operation.

That which is claimed is:

1. Apparatus comprising:

(a) a housing having a generally cylindrical interior surface and having a first end and a second end;

(b) a rotatable drum having a portion thereof positioned in the housing, a generally annular first chamber being defined between an exterior surface of the drum and the interior surface of the housing, a generally cylindrical second chamber being defined by an interior surface of the drum, said drum having a first end positioned adjacent the first end of the housing a second end positioned adjacent the second end of the housing;

(c) a tubular member having a first end and a second end positioned generally axially in the second chamber, said tubular member extending for a major portion of the length of the second chamber, the interior of the tubular member being at least in substantial isolation from the second chamber;

(d) a first conduit means connecting the tubular member in flow communication with the annular first chamber, said conduit means opening into said tubular member adjacent said tubular member first end for flow of heating medium from adjacent the first end of the annular first chamber to the interior of the tubular member; and (e) a second conduit means connecting the tubular member in flow communication with the annular first chamber, said conduit means opening into said tubular member adjacent said tubular member second end for flow of heating medium from the interior of the tubular member adjacent the second end of the annular member to the tubular first chamber.

2. An apparatus as in claim 1 further comprising:

(a) a first inlet means opening into the annular first chamber adjacent the first end of the housing and operable the introduction of a heating medium into the annular first chamber;

(b) a first outlet means opening into the annular first chamber adjacent the second end of the housing and operable for the discharge of heating medium from the annular chamber;

(c) a second inlet means communicating with the second chamber at the first end of the drum operable for introducing particulate material to be dried into the second chamber;

(d) a second outlet means communicating with the second chamber at the second end of the drum operable for discharge of particulate material from the second chamber; and (e) drive means cooperating with the drum for rotating the drum about its longitudinal axis.

3. Apparatus as in claim 2 further comprising:

(a) an expansion joint connecting a first portion of the tubular member to a second position of the tubular member; and (b) a plurality of fins attached longitudinally to the exterior of the tubular member.

4. Apparatus as in claim 3 further comprising a bracket attached to the interior of the drum slidably supporting the tubular member between its first end and its second end.

5. Apparatus as in claim 3 wherein:

(a) the first and second conduit means each comprise a plurality of conduits extending generally radially outwardly from the tubular member to the drum, each conduit having one end opening into the annular chamber and the other end opening into the interior of the tubular member;

(b) the first and second ends of the housing are open ends and a portion of the drum adjacent the first end of the drum extends through the open first end of the housing and a portion of the drum adjacent the second end of the drum extends through the open second end of the housing; and (c) the first inlet means and the first outlet means each open into the annular first chamber in a generally tangential direction.

6. A method for drying carbon black pellets in a drying zone comprising a drum having an inlet end and an outlet end, the drum being within a housing defining an annular chamber surrounding a major portion of the length of the drum, said method comprising:

introducing moisture-containing carbon black pellets into the inlet end of the drum and passing the pellets through the drum to the outlet end thereof;

introducing a heating medium into the annular chamber near the inlet end of the drum;

passing a first portion of the heating medium through the annular chamber in a cocurrent indirect heat exchange with the carbon black pellets passing through the drum;

introducing a second portion of the heating medium into a first end of a tubular member within and extending coaxially along a major portion of the length of the drum, the first end of the tubular member being near the inlet end of the drum;

passing the second portion of the heating medium through the tubular member in cocurrent indirect heat exchange with the carbon black pellets passing through the drum;

discharging the second portion of the heating medium from the tubular member and into the annular chamber at a position near the outlet end of the drum; and discharging the combined first and second portions of the heating medium from the annular chamber via a heating medium outlet near the outlet end of the drum.

7. A method as in claim 6 further comprising:

(a) agitating the carbon black pellets as they are passed from the inlet to the outlet of the drum by rotation of the drum about its longitudinal axis; and (b) discharging substantially dry carbon black pellets at the outlet end of the drum.

8. A method as in claim 7 further comprising: indirectly effecting heat exchange between the heating medium passing through the tubular member and the carbon black pellets in the drum via fins affixed to and extending longitudinally along the tubular member.

9. A method as in claim 8 wherein the heating medium is introduced tangentially with respect to the annular chamber via the heating medium inlet so as to effect vortex flow of heating medium along the annular chamber.

10. A method as in claim 9 wherein the heating medium is discharged from the annular chamber generally tangentially so as to effect corotational discharge of heating medium from the annular chamber.

* * * * *